US007240718B2

(12) United States Patent
Schmidt et al.

(10) Patent No.: US 7,240,718 B2
(45) Date of Patent: Jul. 10, 2007

(54) METHOD FOR CASTING CORE REMOVAL

(75) Inventors: Wayde R. Schmidt, Pomfret Center, CT (US); Mark R. Jaworowski, Glastonbury, CT (US); James T. Beals, West Hartford, CT (US); Vincent C. Nardone, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/225,512

(22) Filed: Sep. 13, 2005

(65) Prior Publication Data

US 2007/0056709 A1 Mar. 15, 2007

(51) Int. Cl.
*B22D 29/00* (2006.01)

(52) U.S. Cl. ..... 164/132; 164/345; 134/2; 134/166 R

(58) Field of Classification Search ..... 164/132, 164/345; 134/2, 166 R
See application file for complete search history.

(56) References Cited

U.S. PATENT DOCUMENTS 2,679,669 A * 6/1954 Kempe ..... 164/32
4,043,381 A * 8/1977 Mazdiyasni et al. ..... 164/65
4,141,781 A 2/1979 Greskovich et al.
4,287,932 A * 9/1981 Schneider ..... 164/516
4,379,723 A * 4/1983 Zollner geb. Moller ..... 134/2
5,298,204 A 3/1994 O'Connor et al.
5,679,270 A * 10/1997 Thornton et al. ..... 216/101
5,915,452 A * 6/1999 Conroy et al. ..... 164/345
6,241,000 B1 6/2001 Conroy et al.
6,637,500 B2 * 10/2003 Shah et al. ..... 164/369
6,739,380 B2 5/2004 Schlienger et al.
6,951,239 B1 * 10/2005 Snyder et al. ..... 164/516

FOREIGN PATENT DOCUMENTS

EP 0924008 A1 6/1999

OTHER PUBLICATIONS

European Search Report for EP Patent Application No. 06254757.5.

* cited by examiner

*Primary Examiner*—Kevin Kerns
*Assistant Examiner*—Ing-Hour Lin
(74) *Attorney, Agent, or Firm*—Bachman & LaPointe, P.C.

(57) ABSTRACT

A thermal-oxidative process is used to remove a casting core from a cast part.

26 Claims, 10 Drawing Sheets

METHOD FOR CASTING CORE REMOVAL

BACKGROUND OF THE INVENTION

The invention relates to investment casting. More particularly, the invention relates to the removal of metallic casting cores from cast parts.

Investment casting is commonly used in the aerospace industry. Various examples involve the casting of gas turbine engine parts. Exemplary parts include various blades, vanes, seals, and combustor panels. Many such parts are cast with cooling passageways. The passageways may be formed using sacrificial casting cores.

Exemplary cores include ceramic cores, refractory metal cores (RMCs), and combinations thereof. In exemplary combinations, the ceramic cores may form feed passageways whereas the RMCs may form cooling passageways extending from the feed passageways through walls of the associated part.

After the casting of the part (e.g., from a nickel- or cobalt-based superalloy), the casting shell and core(s) are destructively removed. Exemplary shell removal is principally mechanical. Exemplary core removal is principally chemical. For example, the cores may be removed by chemical leaching. Exemplary leaching involves use of an alkaline solution in an autoclave. Exemplary leaching techniques are disclosed in U.S. Pat. Nos. 4,141,781, 6,241,000, and 6,739,380.

Especially where long and/or fine passageways are concerned, the leaching may be quite time-consuming. Problems faced in leaching include: minimizing adverse effects on the cast part; effective leaching of both metallic and ceramic cores where a combination is used; residual contaminants from the leaching media; potential exposure to hazardous materials; safe/environmentally-friendly disposal of residual leaching media and leachant by-products.

SUMMARY OF THE INVENTION

One aspect of the invention involves a thermal-oxidative process used to destructively remove a refractory metal casting core from a cast part.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
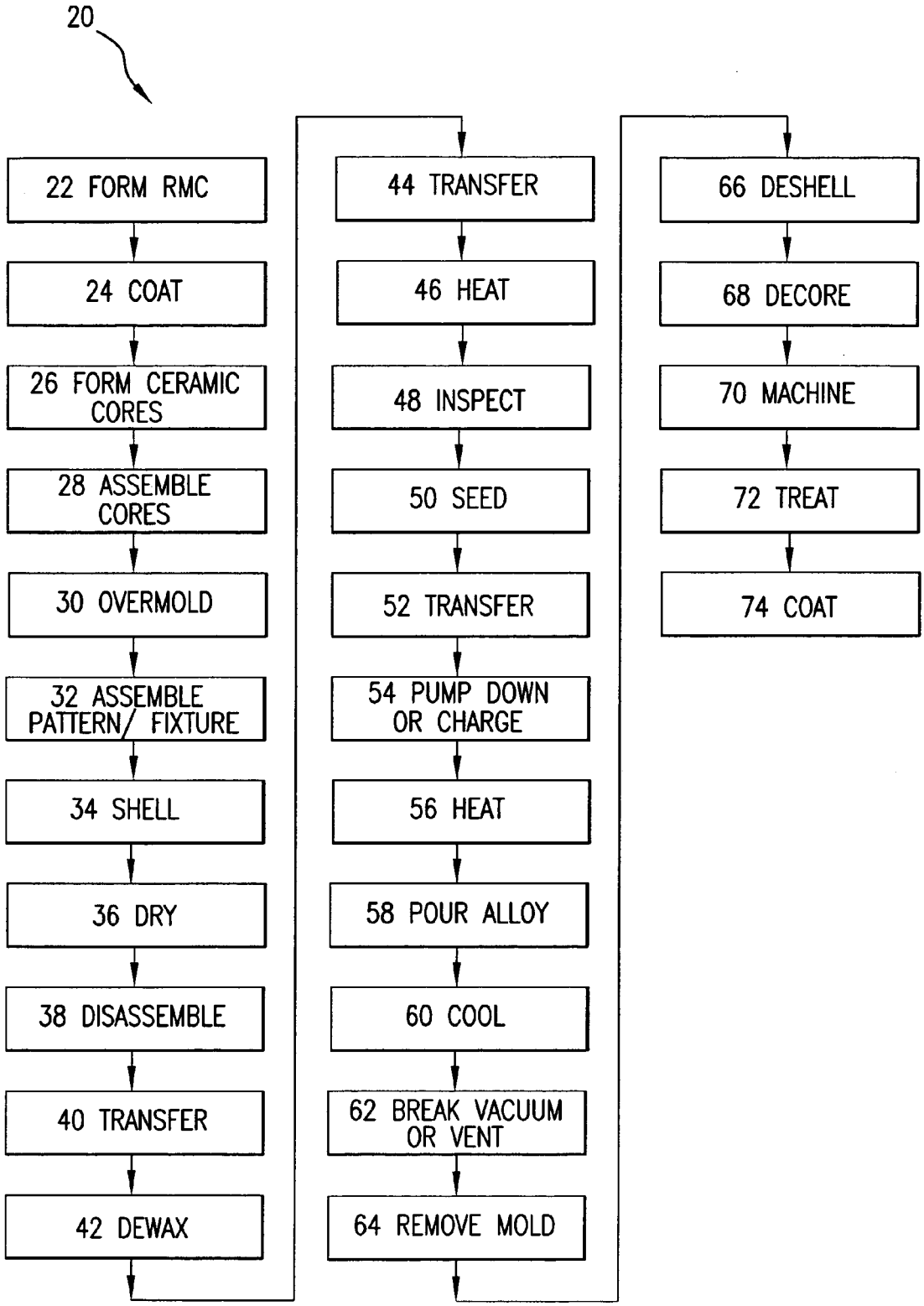
FIG. 1 is a flowchart of an investment casting process.

FIG. 1 shows an exemplary method 20 for forming an investment casting mold. Other methods are possible, including a variety of prior art methods and yet-developed methods. One or more metallic core elements are formed 22 (e.g., of refractory metals such as molybdenum and niobium by stamping or otherwise cutting from sheet metal) and coated 24. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

One or more ceramic cores may also be formed 26 (e.g., of or containing silica in a molding and firing process). One or more of the coated metallic core elements (hereafter refractory metal cores (RMCs)) are assembled 28 to one or more of the ceramic cores. The core assembly is then overmolded 30 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 32 to a shelling fixture (e.g., via wax welding between end plates of the fixture). The pattern may then be shelled 34 (e.g., via one or more stages of slurry dipping, slurry spraying, or the like). After the shell is built up, it may be dried 36. The drying provides the shell with at least sufficient strength or other physical integrity properties to permit subsequent processing. For example, the shell containing the invested core assembly may be disassembled 38 fully or partially from the shelling fixture and then transferred 40 to a dewaxer (e.g., a steam autoclave). In the dewaxer, a steam dewax process 42 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 44 to a furnace (e.g., containing air or other oxidizing atmosphere) in which it is heated 46 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 48. The mold may be seeded 50 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures of various alloys including nickel- and/or cobalt-based superalloys. The mold may be transferred 52 to a casting furnace (e.g., placed atop a chill plate in the furnace). The casting furnace may be pumped down to vacuum 54 or charged with a non-oxidizing atmosphere (e.g., inert gas) to prevent oxidation of the casting alloy. The casting furnace is heated 56 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 58 into the mold and the mold is allowed to cool to solidify 60 the alloy (e.g., after withdrawal from the furnace hot zone). After solidification, the vacuum may be broken 62 and the chilled mold removed 64 from the casting furnace. The shell may be removed in a deshelling process 66 (e.g., mechanical breaking of the shell).

The core assembly is removed in a decoring process 68 to leave a cast article (e.g., a metallic precursor of the ultimate part). Inventive multi-stage decoring processes are described below. The cast article may be machined 70, chemically and/or thermally treated 72 and coated 74 to form the ultimate part. Some or all of any machining or chemical or thermal treatment may be performed before the decoring.

The exact nature of an appropriate decoring process 68 will depend on several factors. These factors include: the particular material(s) of the RMC(s), including any coating; the particular material(s) of any ceramic core(s); the particular casting alloy; and the core geometries. The materials provide various issues of effectiveness and compatibility with chemical and oxidative removal techniques. The geometry issues influence the accessibility and required exposures.

A first group of exemplary inventive processes involve use of a thermal-oxidative mechanism preferentially to remove the RMC(s). For example, the thermal-oxidative mechanism may remove a majority of the RMC(s) while leaving the ceramic core(s) (already oxidized and not subject to volatilization) essentially intact. The associated process might, however render the ceramic core(s) more soluble. A chemical leaching mechanism may be used to preferentially remove the ceramic core(s). More broadly, the thermal-oxidative mechanism may remove a greater proportion of one or more first RMC(s) than of one or more other cores (e.g., different RMCs or ceramic core(s)) and may remove a majority of the first RMC(s) while only a minor portion of the other core(s). The chemical leaching mechanism may be used to preferentially remove the other core(s).

Figure 2:
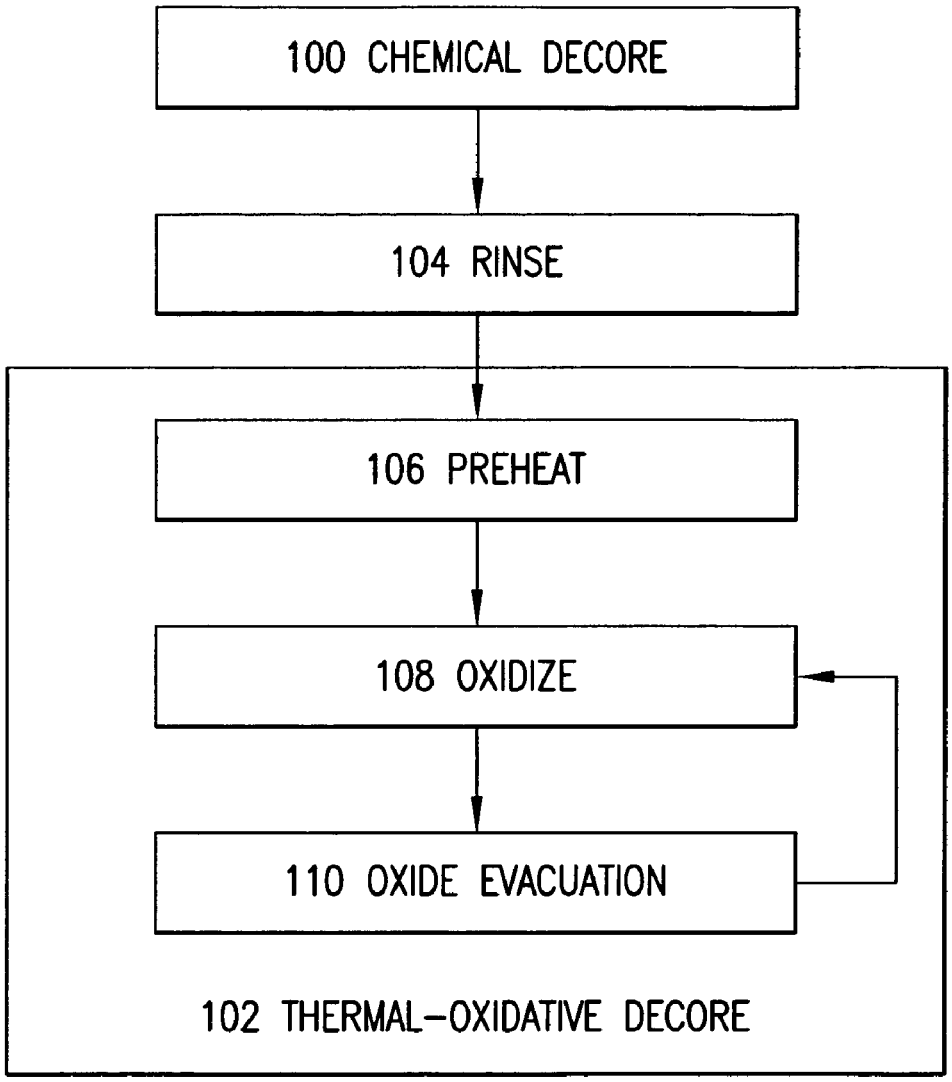
FIG. 2 is a flowchart of an exemplary decoring process within the process of FIG. 1.

FIG. 2 shows one such exemplary decoring process wherein a chemical process 100 precedes a thermal-oxidative process 102. An exemplary chemical process includes placing the casting in an autoclave and immersing the casting in an alkaline solution (e.g., aqueous or alcoholic sodium hydroxide or potassium hydroxide). The solution exposure may be at an elevated pressure (e.g., 1-5 MPa) and a moderately elevated temperature (e.g., 150-400° C.). The pressure and/or temperature may be cycled and/or the solution otherwise agitated to maintain exposure of the alkaline solution to the ceramic and evacuate reaction products.

After an optional cleaning rinse 104, the exemplary thermal-oxidative process 102 includes exposing to an oxygen-containing atmosphere at elevated temperature. The exposing may involve a cycling of temperature, pressure, and/or atmosphere composition. The cycling may improve net throughput by facilitating oxygen access to base metal of the RMC(s) and/or evacuating reaction products.

Figure 11:
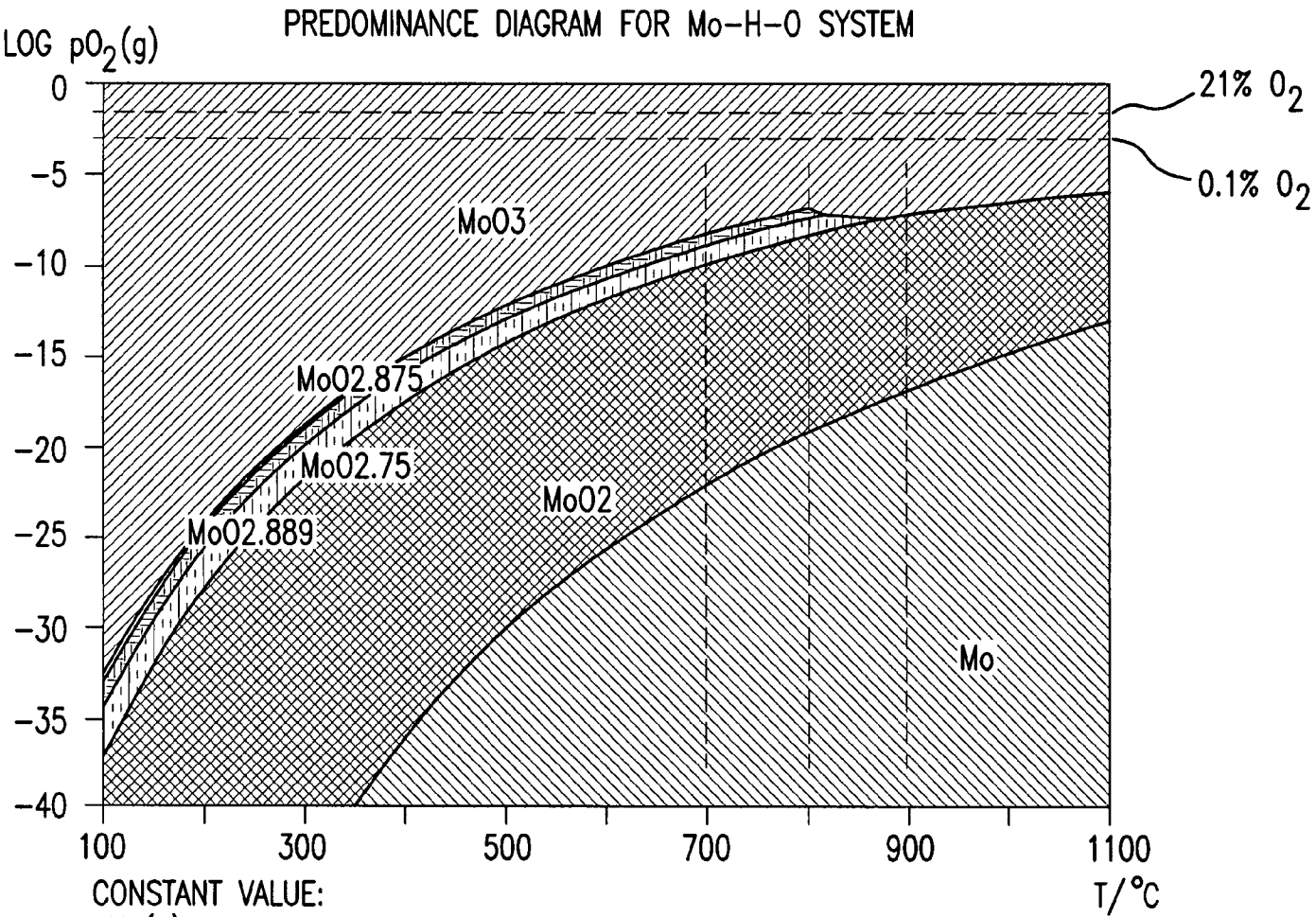
FIG. 11 is a predominance diagram for the Mo—H—O system.

For example, the oxidation of molybdenum metal to molybdenum oxide produces a solid species with relatively very low density (Mo is 10.3 g/cm$^3$; $MoO_2$ being 6.47 g/cm$^3$; $MoO_3$ being 4.69 g/cm$^3$). Thus, there is a very large volumetric expansion upon oxidation of the Mo metal to an Mo oxide. If such an expansion occurs within a narrow (small cross-sectional area in absolute terms and/or relative to length) passageway, it is possible to plug such a passageway with solid oxide, thereby cutting off the flow path for further oxidation. $MoO_3$ is a preferable oxide due to a greater volatility (more easily evacuated and less likely to plug) than $MoO_2$ or oxide compositions intermediate between $MoO_2$ and $MoO_3$. $MoO_3$ tends to form at higher oxygen partial pressures relative to $MoO_2$. as can be determined from published thermochemical data for the Mo—H—O system such as shown in FIG. 11. FIG. 11 also indicates that the formation of undesirable low-volatility intermediate oxide compositions such as $MoO_{2.75}$, $MoO_{2.875}$ and $MoO_{2.889}$ is suppressed at temperatures above 870° C.

Passageway cross-sections may be round, square, rectangular or other. Exemplary passageway cross-sectional areas are 0.05-5.0 mm$^2$ for round or near square cross-sections. For wide passageways, exemplary heights are 0.20-2.0 mm. exemplary lengths are 0.20-250 mm.

Thus, an exemplary process 102 includes a preheat 106 in an inert atmosphere to achieve an operative temperature. The preheat may serve to bring the casting to a temperature where the oxide formation is biased toward $MoO_3$. The preheat is followed by exposure 108 to an oxidizer. This inert preheat/oxidize sequence may also limit undesired oxidation of the casting relative to a heating in the oxidizing atmosphere. The sequence may also limit plugging of narrow passageways by solid oxide (especially $MoO_2$ and intermediate oxide compositions between $MoO_2$ and $MoO_3$ as in the published predominance diagrams). If considerable access to the refractory metal core is available (e.g., due to wider passageways, shorter passageways and/or access from multiple locations), the rate of oxidation can be increased while still avoiding plugging.

An exemplary cycling comprises repeated intervals 110 under different conditions to encourage evacuation of oxides. These intervals 110 may comprise reduced or increased total pressure, reduced or increased temperature, reduced or increased oxygen partial pressure, introduction of a reducing agent, and/or other changed condition. Exemplary reducing agents are hydrogen, ammonia, and/or methane. Gases generally considered inert such as nitrogen and argon are exemplary diluents useful for controlling the overall gas composition.

Figure 3:
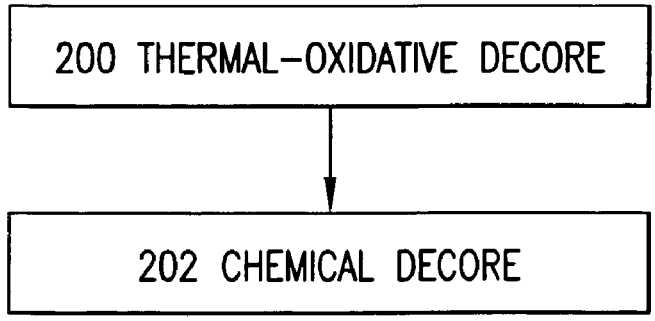
FIG. 3 is a flowchart of an alternate decoring process.

FIG. 3 shows another such exemplary decoring process wherein a thermal-oxidative process 200 (e.g., similar to 102) precedes a chemical process 202 (e.g., similar to 100). This may be warranted where chemical attack on the casting is sought to be minimized. Depending on core configuration, there may be a moderate increase in the time required for the thermal-oxidative process (e.g., a doubling or slightly greater) relative to the FIG. 2 process. However, the chemical process may be reduced even more substantially (e.g., to less than a third). For example, access through outlet passageways left by an RMC may allow near instant attack by the chemical along the length of a ceramic feedcore.

Figure 4:
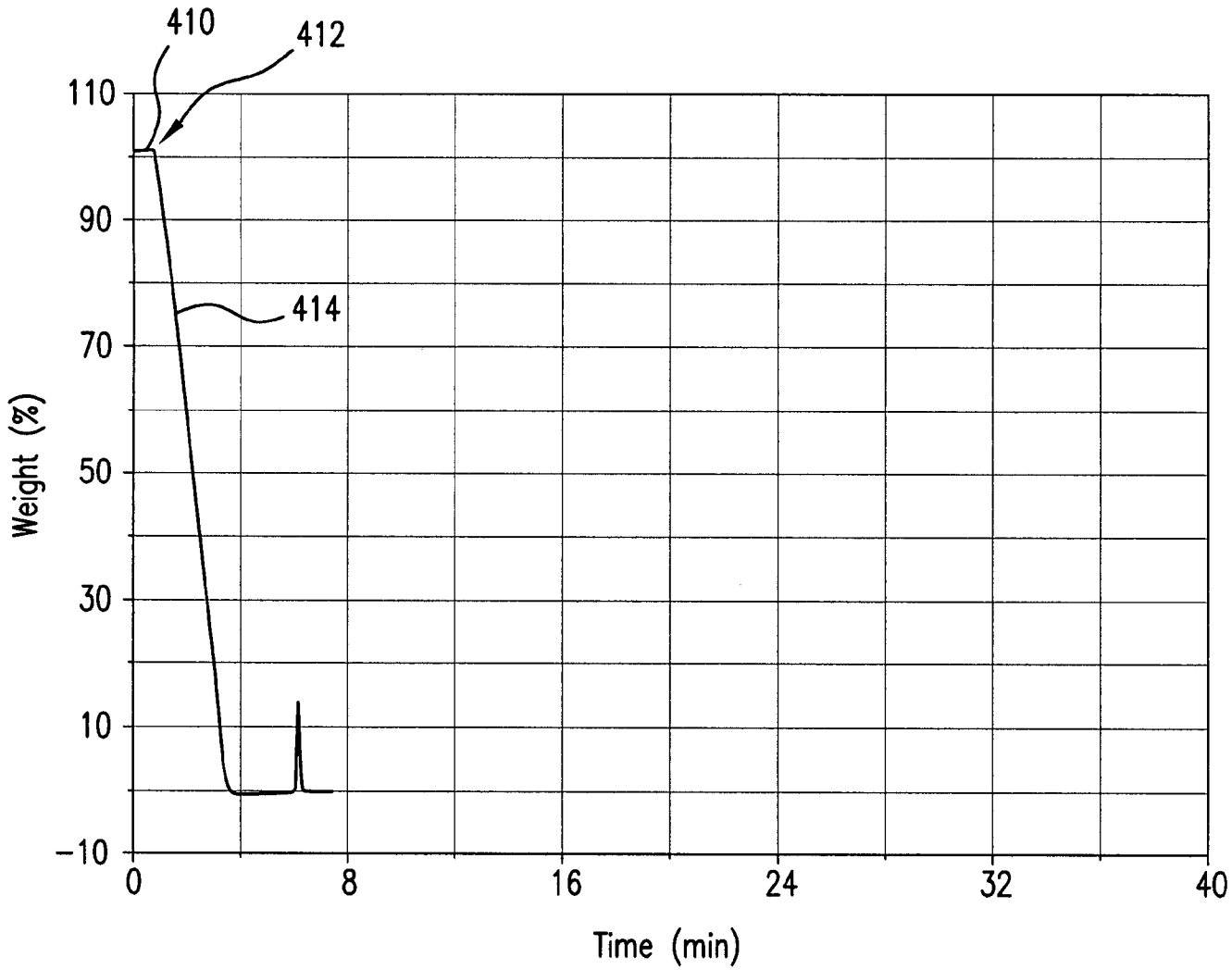
FIGS. 4-6 are graphs showing loss of refractory metal material against time in air at various temperatures.
Figure 5:
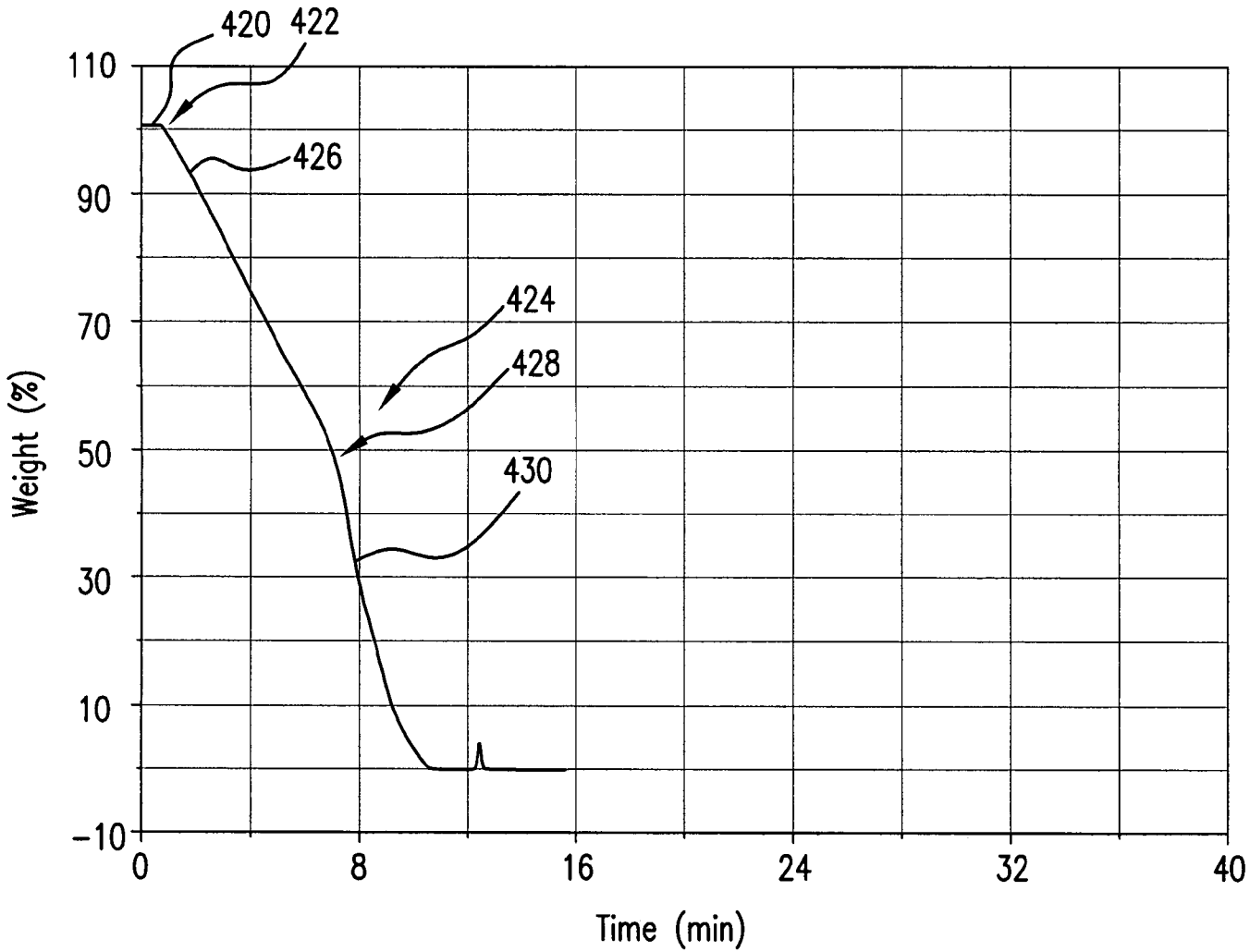
Figure 6:
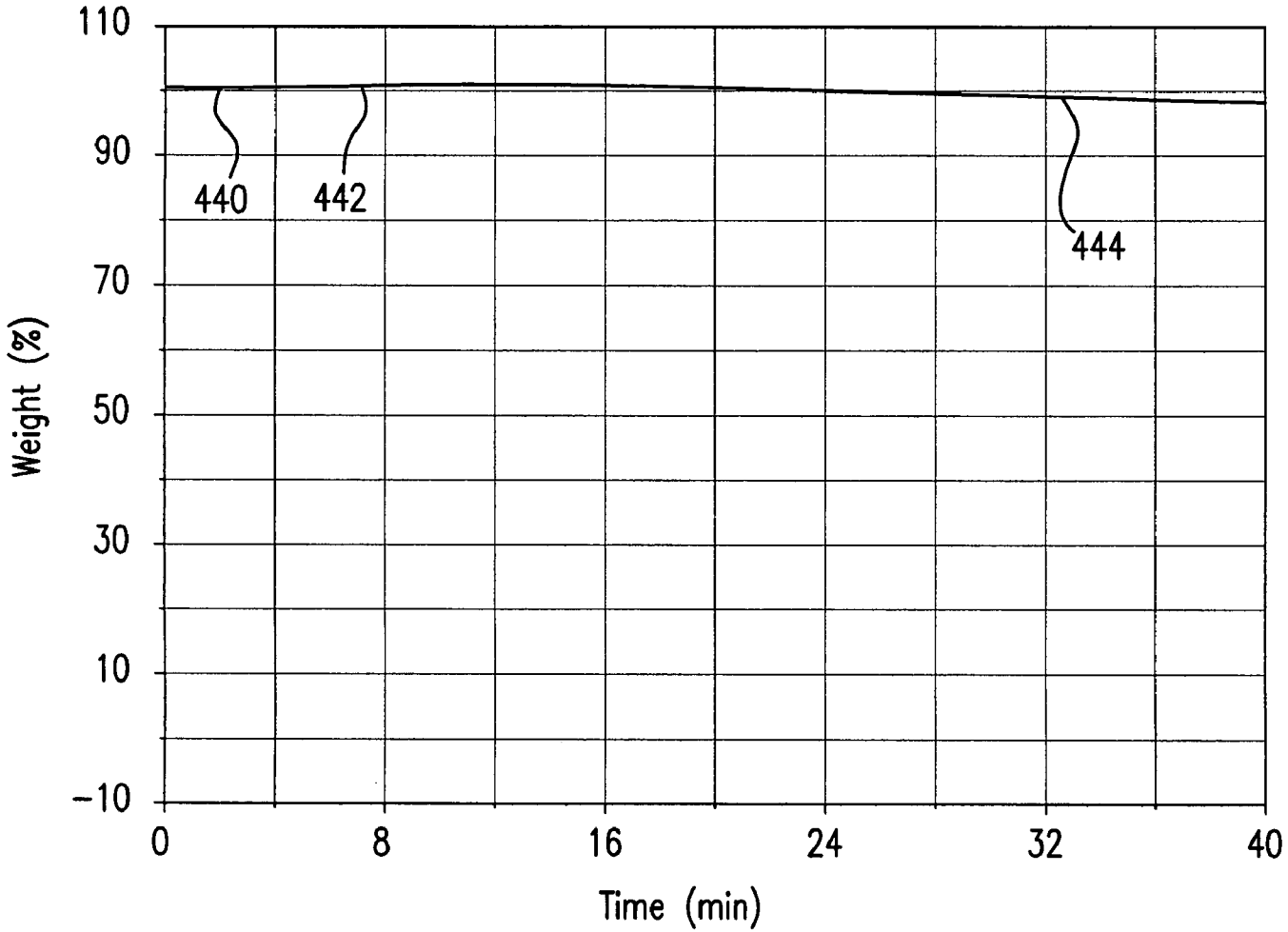

Experiments regarding the oxidation of molybdenum have indicated a number of relevant physical and chemical mechanisms for consideration in the selection of appropriate parameters of the thermal-oxidative removal process. Oxidation experiments were carried out on 0.003 inch (0.08 mm) molybdenum foil. The foil was exposed to an oxidative atmosphere at elevated temperature. A first series of experiments involved air as the oxidative atmosphere and involved elevated temperatures of 700° C., 800° C., and 900° C. The foil was heated in argon and then air was introduced. FIGS. 4-6 show the non-volatized mass of the foil (as a percentage of the original mass) against time after initial oxygen introduction. At 900° C. (FIG. 4), there is an initial stage 410 where the mass is essentially unchanged. An abrupt transition 412 occurs at about one minute after exposure to oxygen. After the transition 412 there is a rapid loss of mass in a loss stage 414. The approximate slope of the graph for most of that loss is −37.4%/minute for the exemplary thickness of foil being exposed on two sides.

At 800° C. (FIG. 5), there also is an initial stage 420, a transition 422, and a loss stage 424. The onset of substantial mass loss is relatively delayed. The loss is also more gradual. Certain aspects of the loss mechanism may be easier to visualize on the graph. Specifically, after the transition 420, there is a first loss stage 426. During this first stage 422, mass loss is relatively constant. This stage 422 accounts for near to about half the initial mass. The approximate slope of the graph for most of the stage 426 loss is −8.2%/minute. There appears to be a transition 428 to a more rapid second loss stage 430. The approximate slope of the graph for most of the stage 426 loss is −16.7%/minute. This transition 428 may result from the interplay of more than one loss mechanism. For example, the observed behavior at 800° C. may be due to metastability of reduced Mo oxides at low oxygen partial pressure (such as at the metal interface under the presumed volatilizing $MoO_3$ layer). The increase in rate of weight loss could be due to spallation or surface area enhancement effects accompanying the oxidation process.

At 700° C. (FIG. 6), there is very little loss over the period observed. The graph appears characterized by an initial stage 440, a transition 442, and a loss stage 444 (likely analogous to stage 426 of FIG. 5). In each of the three plots there is an apparent mass increase during at least a latter part of the initial stage. This is believed due to initial oxide formation when there is little release of the oxidized molybdenum from the foil.

Figure 7:
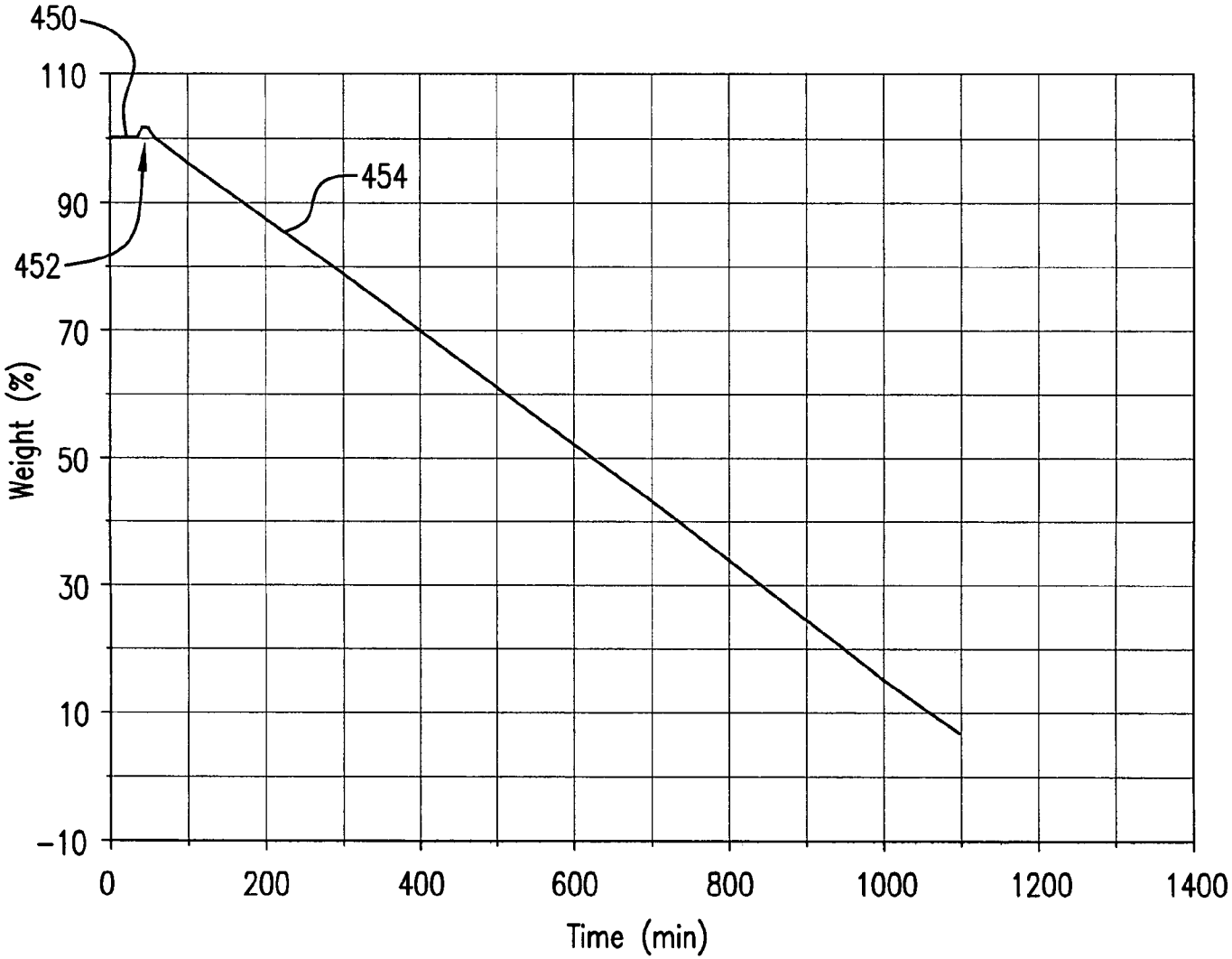
FIGS. 7-9 are graphs showing loss of refractory metal material against time in a low-oxygen environment at various temperatures.
Figure 8:
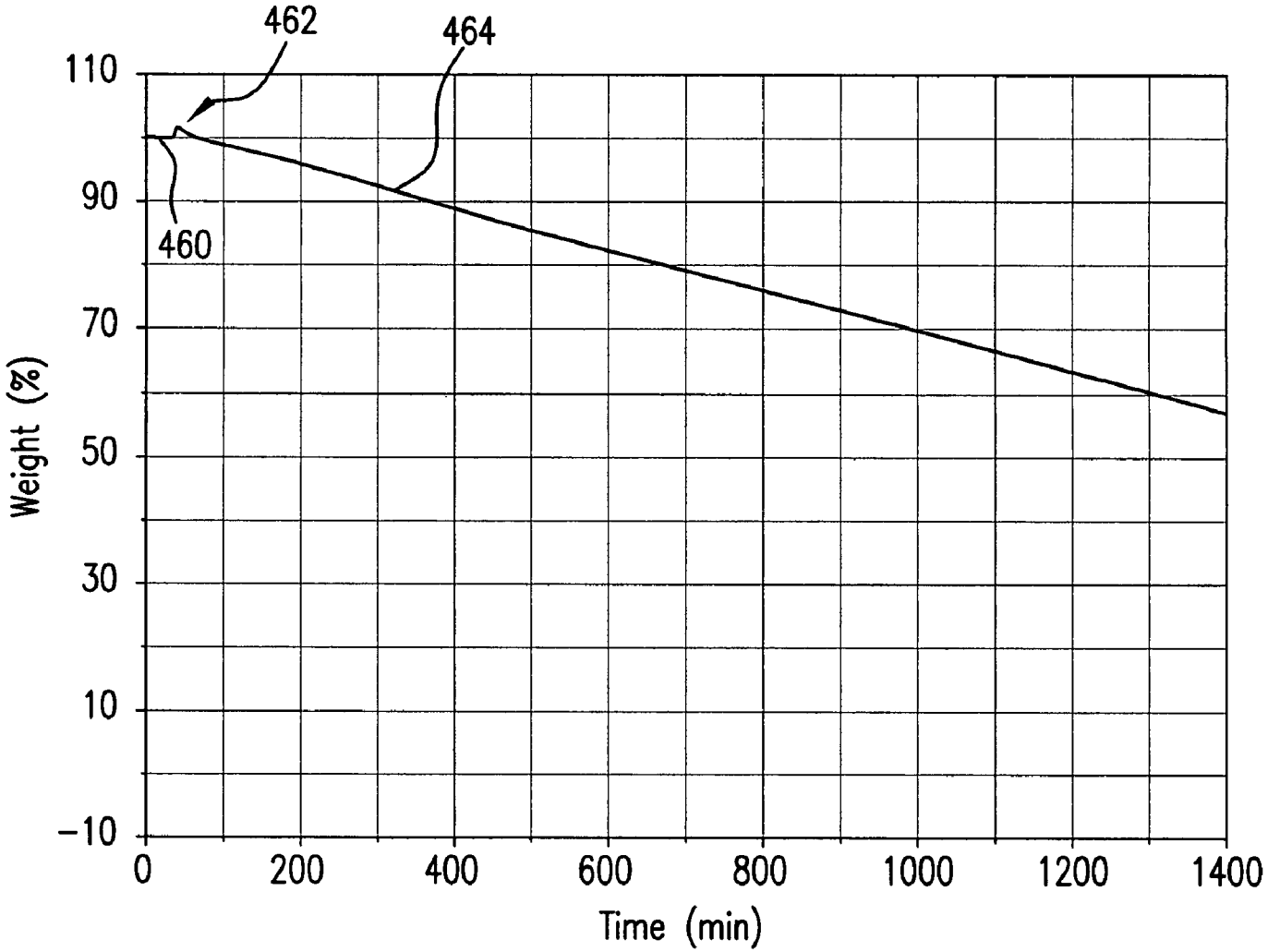
Figure 9:
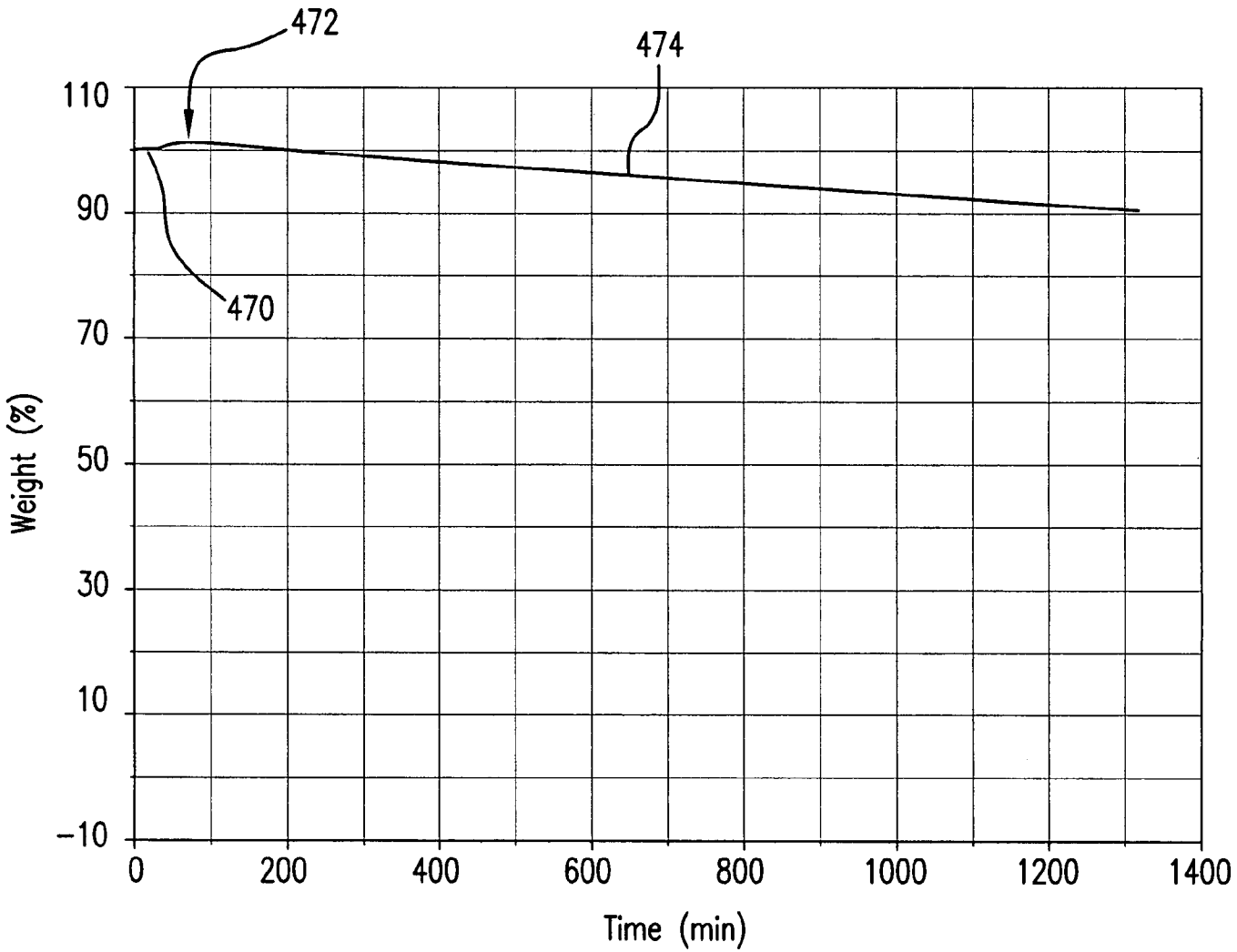

FIGS. 7-9 show similar experiments at ambient pressure but only a 0.1% oxygen concentration, by partial pressure of oxygen in argon. Generally, the effect of the decrease in oxygen partial pressure appears largely one of slowing the loss stages while not substantially delaying the loss onset. At 900° C. (FIG. 7), there is an initial stage 450 where there is little mass change. A brief transition 452 features a mass increase likely from the initial oxidation discussed above. A loss stage 454 follows. The approximate slope of the graph for most of the stage 454 loss is −0.090%/minute.

At 800° C. (FIG. 8), there is an initial stage 460 where there is little mass change. A brief transition 462 features a mass increase likely from the initial oxidation discussed above. A relatively slow loss stage 464 follows and is recorded for less than half the lost mass, thereby not precluding a later increased loss stage as in FIG. 5. The approximate slope of the graph for most of the stage 464 loss is −0.032%/minute.

At 700° C. (FIG. 9), there is an initial stage 470 similar in duration to the stage 460 of FIG. 8. A transition 472 and a loss stage 474 are further slowed relative to their FIG. 8 counterparts. The approximate slope of the graph for most of the stage 474 loss is −0.0085%/minute.

Figure 10:
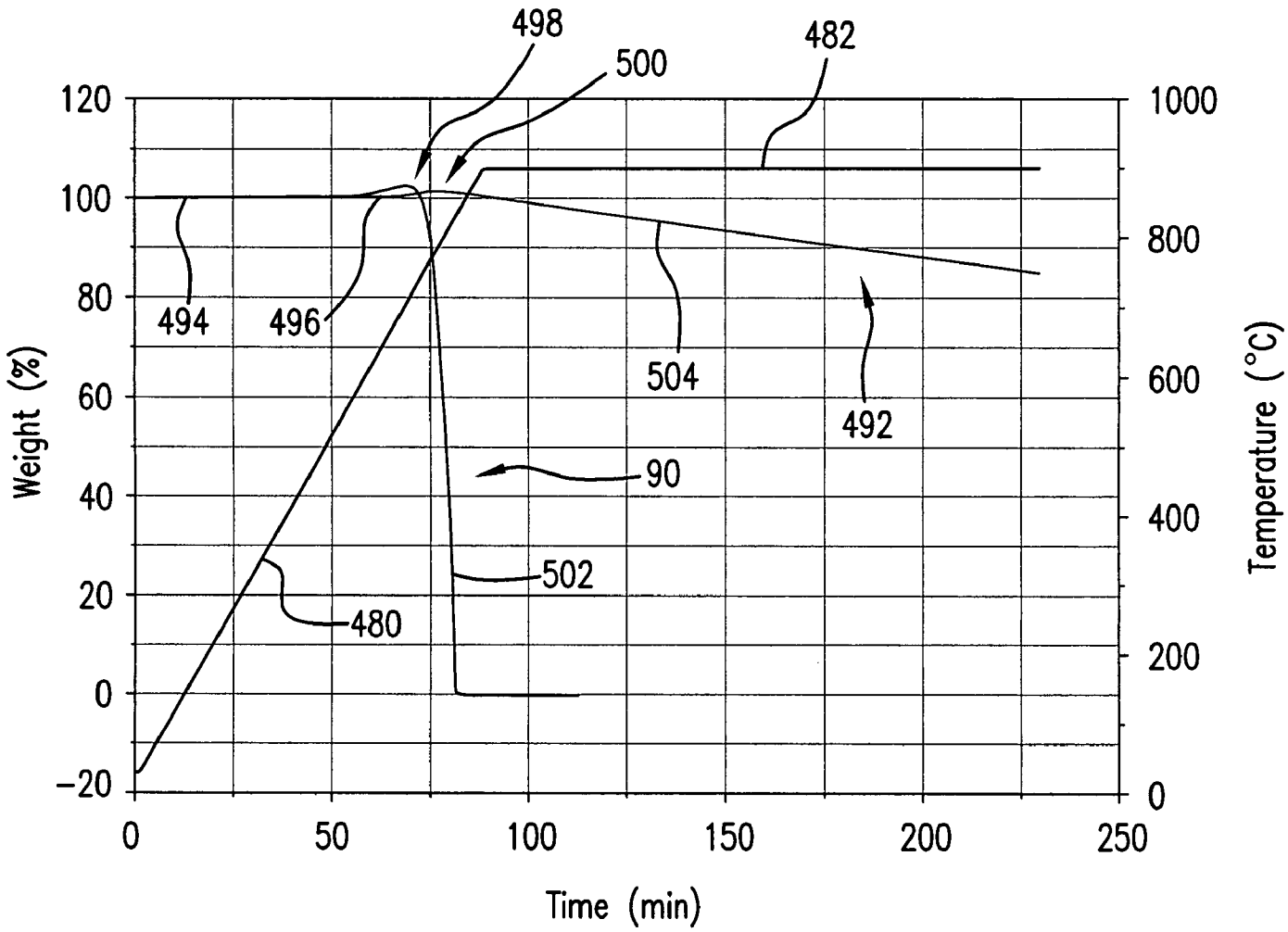
FIG. 10 is a graph showing loss of refractory metal material against time in both air and the low-oxygen environment during a heating and 900° C. hold.

Additional experiments featured heating in the ultimate atmosphere rather than heating in an inert atmosphere. FIG. 10 shows the temperature as including a heating stage 480 followed by a steady stage 482 at 900° C. Plots 490 and 492 respectively show weight percentages for the 21% and 0.1% oxygen atmospheres. The plots are characterized by respective initial stages 494 and 496, transition stages 498 and 500, and loss stages 502 and 504. The loss stage 502 is an essentially total loss stage and is characterized by a majority of loss at an approximate rate of −13.4%/minute. The loss stage 504 was plotted for only as small fraction of total loss at an approximate rate of −0.11%/minute. Noteworthy is that the stage 502 involves substantially slower loss than the stage 414. The stage 504, by contrast involves slightly faster loss than the stage 454. The stage 502 loss rate might be slowed by particular oxides formed at lower temperatures having a protective effect. The protective effect may be substantial only for relatively high oxygen contents.

Thus, an exemplary cycling may involve exposing to oxygen that partial pressure of at least 0.015MPa interposed with intervals of reduced total pressure. The reduced total pressure maybe below 0.01MPa. The oxygen partial pressure during the exposing may be 0.015-0.025MPa.

One or more embodiments of the present invention have been described. Nevertheless, it will be understood that various modifications may be made without departing from the spirit and scope of the invention. For example, the principles may be implemented as modifications of existing or yet-developed processes in which cases those processes would influence or dictate parameters of the implementation. Accordingly, other embodiments are within the scope of the following claims.

What is claimed is:

1. A method comprising:

destructively removing a casting core from a cast part by exposing the casting core to oxygen at a temperature of 700-1000° C., wherein the exposing is at an oxygen partial pressure of at least 0.015 MPa interposed with intervals of reduced total pressure.

2. The method of claim 1 thither comprising:

molding a sacrificial pattern over said casting core;

forming a shell over the pattern;

destructively removing the pattern from the shell, leaving the casting core;

casting a metallic material in the shell; and destructively removing the shell.

3. The method of claim 1 wherein:

the exposing is preceded by a preheating in an essentially oxygen-free atmosphere.

4. The method of claim 1 wherein:

the exposing is preceded by a preheating essentially to said temperature in lower oxygen partial pressure than a median oxygen partial pressure of the exposing.

5. The method of claim 1 wherein:

the preheating of the casting core and cast part is in an essentially oxygen-free atmosphere.

6. The method of claim 1 wherein:

the reduced total pressure comprises total pressure below 0.01 MPa.

7. The method of claim 1 wherein:

the preheating of the casting core and cast part is essentially to said temperature in lower oxygen partial pressure than a median oxygen partial pressure of the exposing.

8. The method of claim 1 wherein:

the casting core consists essentially of a refractory metal-based core.

9. The method of claim 8 wherein:

the casting core is a first casting core; and the method includes removing a second casting core from the cast part, principally by alkaline leaching.

10. The method of claim 9 wherein:

the alkaline leaching is substantially performed after the removal of the first casting core.

11. The method of claim 1 wherein the casting core consists essentially of molybdenum.

12. The method of claim 1 wherein:

the temperature is 700-900° C.

13. The method of claim 1 used to manufacture a gas turbine engine component.

14. The method of claim 1 wherein the cast part consists essentially of a nickel-based superalloy.

15. The method of claim 1 wherein the exposing is at an oxygen partial pressure of at least 0.015 MPa while maintaining said temperature of 700-1000° C.

16. The method of claim 1 wherein the destructive removing further includes alkaline leaching.

17. A method for removing a ceramic first casting core and a refractory metal-based second casting core from a cast part comprising:

a first step for removing a major portion of the first casting core; and a second step, distinct from said first step, for removing a major portion of the second casting core and comprising:

a plurality of first intervals for inducing oxidation of the second core; and a plurality of second intervals for evacuating oxidation products of the second core.

18. The method of claim 17 wherein:

the second step comprises exposing the second core to oxygen at a temperature of 700-1000° C.

19. The method of claim 17 wherein:

the first step comprises exposing the first core to an alkaline solution at a temperature of below 500° C.

20. The method of claim 17 used to manufacture a gas turbine engine component.

21. The method of claim 17 wherein the cast part consists essentially of a nickel-based superalloy.

22. The method of claim 17 wherein the second core consists essentially of molybdenum or niobium.

23. The method of claim 17 wherein the first core consists essentially of a silica-based material.

24. A method comprising;

destructively removing a casting core from a cast part by exposing the casting core to oxygen at a temperature of 700-1000° C., wherein the exposing is at an oxygen partial pressure of 0.015-0.025 MPa interposed with intervals of an oxygen partial pressure of at least 0.05MPa.

25. A method comprising:

molding a sacrificial pattern over a casting core;

forming a shell over the pattern;

destructively removing bag the pattern from the shell, leaving the casting core;

casting a metallic material in the shell;

destructively removing the shell; and destructively removing a casting core from a cast part comprising:

exposing the casting core to oxygen at a temperature of 700-1000° C., the exposing preceded by a preheating of the casting core and cast part in a lower oxygen content than the exposing.

26. A method comprising:

destructively removing a casting core from a cast part by exposing the casting core to oxygen at a temperature of 700-1000° C., wherein;

the casting core consists essentially of a refractory metal-based core;

the casting core is a first casting core;

the method includes removing a second casting core from the cast part, principally by alkaline leaching; and the alkaline leaching is substantially performed after the removal of the first casting core.

* * * * *

UNITED STATES PATENT AND TRADEMARK OFFICE

CERTIFICATE OF CORRECTION

PATENT NO. : 7,240,718 B2
APPLICATION NO. : 11/225512
DATED : July 10, 2007
INVENTOR(S) : Wayde R. Schmidt et al.

It is certified that error appears in the above-identified patent and that said Letters Patent is hereby corrected as shown below:

In column 6, claim 1, line 40, delete “thither” and insert --further--.

In column 8, claim 25, line 17, delete “bag”.

Signed and Sealed this

Eighteenth Day of December, 2007

JON W. DUDAS
*Director of the United States Patent and Trademark Office*